United States Patent [19]

Kobayashi et al.

[11] Patent Number: 5,006,898

[45] Date of Patent: Apr. 9, 1991

[54] DEVELOPING APPARATUS FOR XEROGRAPHY

[75] Inventors: Junji Kobayashi; Hiroyoshi Tokoro; Kiyoshi Niinuma; Kensei Hosoya; Masao Chiba, all of Ibaraki, Japan

[73] Assignee: Hitachi Koki Co., Ltd., Tokyo, Japan

[21] Appl. No.: 337,872

[22] Filed: Apr. 14, 1989

[30] Foreign Application Priority Data

Apr. 15, 1988 [JP] Japan ..... 63-94184

[51] Int. Cl.[5] ..... G03G 15/09

[52] U.S. Cl. ..... 355/253; 355/245; 355/251

[58] Field of Search ..... 355/253, 259, 251, 245, 355/246

[56] References Cited

U.S. PATENT DOCUMENTS

| | | | |
|---|---|---|---|
| 4,370,049 | 1/1983 | Kuge et al. | 355/259 |
| 4,596,455 | 6/1986 | Kohyama et al. | 355/259 |
| 4,760,422 | 7/1988 | Seimiya et al. | 355/253 |
| 4,780,741 | 10/1988 | Wada et al. | 355/253 |
| 4,851,874 | 7/1989 | Ogiyama | 355/253 |

*Primary Examiner*—A. T. Grimley
*Assistant Examiner*—Sandra L. Hoffman
*Attorney, Agent, or Firm*—Cushman, Darby & Cushman

[57] ABSTRACT

A developing apparatus for xerography including a developing roll, a regulator member for controlling developer thickness located proximate to the developing roll, and an elastic plate member arranged to elastically apply pressure to uniformly spread the developer on the developing roll.

2 Claims, 1 Drawing Sheet

DEVELOPING APPARATUS FOR XEROGRAPHY

BACKGROUND OF THE INVENTION

The present invention relates to a developing apparatus, and more particularly to a developing apparatus for xerography by which an electrostatic latent image is developed using magnetic developer.

Two different types of magnetic developer compositions are well known in the prior art for xerography developing apparatus. One comprises only magnetic toner and is therefor called a one component developer. The other comprises magnetic carrier particles and insulating toner particles, and is called a two component developer.

The two component developer composition requires two different storage chambers for toner particles and carrier particles. This creates problems in that the whole developer apparatus becomes larger and the controller for toner density becomes complicated. To simplify the whole developing apparatus or to minimize the maintenance, the one component developer is preferred instead of the two component developer.

The developing apparatus typically includes a developing roll, a device for regulating toner layer thickness (hereinafter it is called a doctor blade). The developer roll includes a magnetic brush for uniformly applying the toner on the roll. The clearance between the doctor blade and developing roll for the one component developer should be about one tenth of that for the two component developer. Due to this fact, dust, and agglomerated toner particles caused by electrostatic agglomeration and magnetic agglomeration, tend to clog the aforesaid clearance. This interferes with the magnetic brush on the developing roll, causing poor application of toner by the magnetic brush on the developing roll. This also creates a problem in developing the electrostatic latent image (as demonstrated in FIG. 4). These problems cause misprints by the formation of white lines on the final photograph in a longitudinal direction.

To solve the aforesaid misprint problem, in the prior art as shown in FIG. 5, improvements have been proposed in which magnetic member (12) is arranged near the clearance between the doctor blade (3) and developing roll (1), or to make the front edge of the doctor blade (13) round as in the prior art shown in FIG. 6.

However, heretofore, the aforementioned improvements have not successfully overcome the problems, and they each have disadvantages, described as follows:

(1) Problem with the arrangement of magnetic member.

While the magnetic field of the magnetic member successfully prevents the magnetizable dust from clogging the doctor blade, the field cannot capture the nonmagnetic dust and other nonmagnetic particles. Furthermore, the magnetic member cannot remove all of the magnetizable dust and other particles. Moreover, once the clearance between the doctor blade and developing roll has been clogged, the effectiveness of the arrangement is lost.

(2) Problem with the round edge of the doctor blade.

The round edge of the doctor blade allows dust and motes to pass through the clearance which are about the same size of or a little bit larger than the clearance between the doctor blade and developing roll. The particles, however, which are much larger in size than the clearance, cause the clearance to become clogged, and thus cause misprints.

The present invention is intended to overcome the problems of the prior art, discussed above. An object of the present invention is to provide a developing apparatus for xerography by which the aforementioned difficulties are solved.

SUMMARY OF THE INVENTION

In accordance with a presently preferred exemplary embodiment, the present invention includes a developing apparatus for xerography in which a toner reservoir is arranged between the doctor blade and a plate member located proximate to the developing roll formed by intercepting the toner powder. With this arrangement, developer is recharged to a misprinted portion of the developing roll. Even when dust has clogged the clearance between the doctor blade and the developing roll, there is excellent coverage of the developing roll by toner, thus preventing misprints.

BRIEF DESCRIPTION OF THE DRAWINGS

Further objects and advantages of the present invention will be better understood by carefully reading the following detailed description of the presently preferred exemplary embodiments of this invention in conjunction with the accompanying drawings, of which.

DETAILED DESCRIPTION OF THE PREFERRED EMBODIMENT

The invention will now be described in further detail with reference to the accompanying drawings. However, the following examples are merely provided to aid in the understanding of the present invention, and variations may be made by one skilled in the art without departing from the spirit and scope of the present invention.

Developing roll (1) has a magnetic brush on its surface and carries developer in the direction shown with the arrow (a). With the roll rotating in this direction, developer is scraped by the doctor blade to a uniform thickness of deposit on the roll. The doctor blade regulates the amount and thickness of developer applied at the moment of the thickness regulation. When material clogs the clearance between the doctor blade and developing roll (during regulation of the thickness of the developer layer), developer can not be dispensed at the clogged portion of the clearance. Thus poor coverage of the magnetic brush occurs, resulting in a misprint. To prevent the aforementioned difficulties, a plate member (6) is employed to rectify the poor coverage and is arranged to contact magnetic brush (2) on the developing roll (1). A holder member (7) is applied to position plate member (6) to evenly spread the developer and uniformly cover the developing roll (1).

Figure 1:
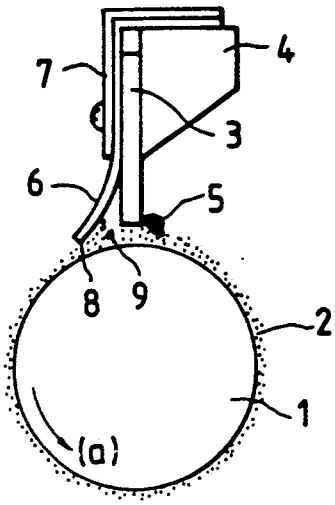
FIG. 1 is a cross sectional view of an example of the developing apparatus of the present invention and showing clogging of the doctor blade.

As shown in FIG. 1, the aforesaid plate member (6) and the aforesaid developing roll converge with close clearance at point (9) to intercept the developer on the developing roll (1).

Figure 3:
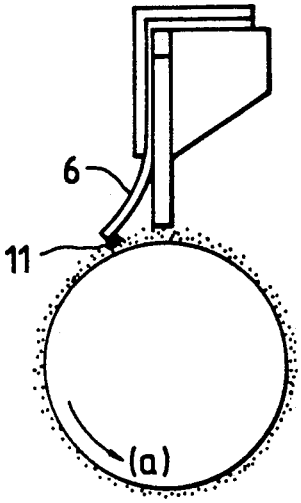
FIG. 3 is a cross sectional view of an example of the developing apparatus of the present invention showing the toner reservoir.

The plate member (6) comprises an elastic material. Thus the plate member would elastically touch the developing roll (1) if there was no developer between the plate member and roll (1). A predetermined amount of developer is spread by the plate member (6) to cover the roll (1) at a predetermined thickness. The elastic pressure of the plate member (6) may be adjusted to increase or decrease the amount of the toner which is spread by the plate member (6). Unused, developer trapped behind plate member (6) (see (11) in FIG. 3) is carried away.

Figure 2:
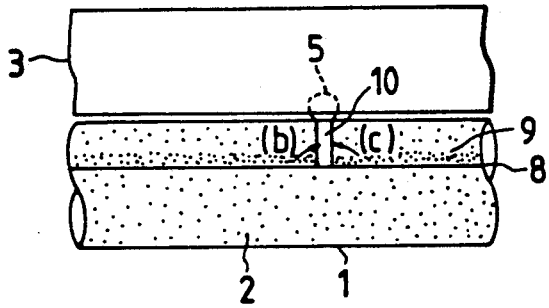
FIG. 2 is a front view of the developing apparatus in FIG. 1.
Figure 4:
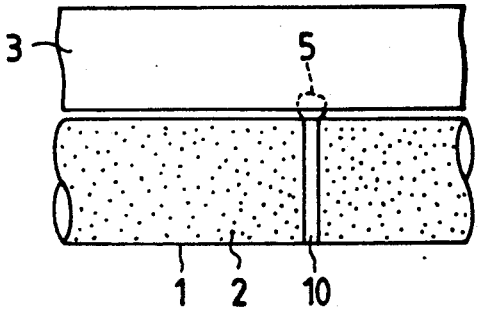
FIG. 4 PRIOR ART
FIG. 4 shows faulty covering of the developing roll with toner in the prior art.
Figure 5:
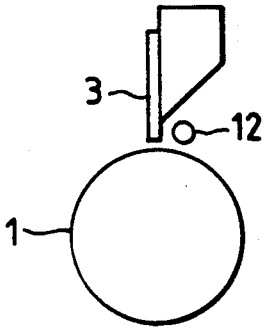
FIG. 5 PRIOR ART
FIG. 5 is a cross sectional view of the developing apparatus in the prior art.
Figure 6:
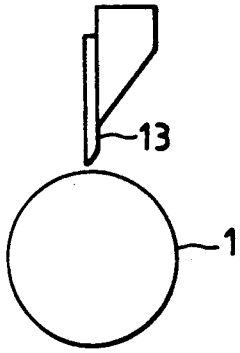
FIG. 6 PRIOR ART
FIG. 6 is a cross sectional view of the developing apparatus in the prior art.

Hereinafter, the operating process employing plate member (6) will be explained with regard to FIG. 2. The developer is supplied to cover the surface area of the roller where there is little developer due to clogging between the doctor blade (3) and roll (1) (this is area (10). Developer accumulated behind plate member (6) along the sides of area (10), shown by arrow marks (a) and (b) is spread by plate member (6) to cover area (10). A misprint will accordingly not occur.

A foreign substance of a size which is small enough to not clog the clearance of the doctor blade, can pass under the plate member (6) to cover the roll as would developer. Such small foreign substances will not cause a misprint.

What is claimed is:

1. A developing apparatus for xerography comprising:

a developing roll;

a regulator member for controlling developer thickness located proximate to said developing roll; and an elastic plate member arranged to elastically apply pressure, independently of said regulator member, so as to uniformly spread the developer across a length of said developing roll.

2. The developing apparatus for xerography of claim 1, wherein said elastic pressure may be adjusted to increase or decrease the amount of said developer that is spread by said plate member.

* * * * *